US006883585B2

(12) United States Patent
Poloni et al.

(10) Patent No.: US 6,883,585 B2
(45) Date of Patent: Apr. 26, 2005

(54) CRYSTALLIZER WITH ROLLERS FOR A CONTINUOUS CASTING MACHINE

(75) Inventors: Alfredo Poloni, Fogliano di Redipuglia (IT); Nuredin Kapaj, Udine (IT)

(73) Assignee: Danieli & C. Officine Meccaniche SpA, Buttrio (IT)

( * ) Notice: Subject to any disclaimer, the term of this patent is extended or adjusted under 35 U.S.C. 154(b) by 0 days.

(21) Appl. No.: 10/478,680

(22) PCT Filed: May 27, 2002

(86) PCT No.: PCT/IB02/01836

§ 371 (c)(1),
(2), (4) Date: Nov. 24, 2003

(87) PCT Pub. No.: WO02/096583

PCT Pub. Date: Dec. 5, 2002

(65) Prior Publication Data

US 2004/0144520 A1 Jul. 29, 2004

(30) Foreign Application Priority Data

May 29, 2001 (IT) ..... UD2001A0101

(51) Int. Cl.[7] ..... B22D 11/06

(52) U.S. Cl. ..... 164/480; 164/428; 164/442; 164/443

(58) Field of Search ..... 164/480, 428, 164/485, 442, 443

(56) References Cited

U.S. PATENT DOCUMENTS

| | | | | |
|---|---|---|---|---|
| 2,850,776 A | | 9/1958 | Hunter | |
| 3,834,205 A | | 9/1974 | Maag et al. | |
| 4,638,851 A | * | 1/1987 | Makihara et al. | 165/289 |

FOREIGN PATENT DOCUMENTS

| | | | |
|---|---|---|---|
| EP | 0873805 | | 10/1998 |
| WO | 9319874 | | 10/1993 |
| WO | 93/19874 | * | 10/1993 |

* cited by examiner

*Primary Examiner*—Kiley S. Stoner
*Assistant Examiner*—I.-H. Lin
(74) *Attorney, Agent, or Firm*—Stevens, Davis, Miller & Mosher, LLP

(57) ABSTRACT

Crystallizer comprising two crystallizer rollers disposed substantially parallel to each other to define a meniscus of liquid steel arriving from a tundish. The crystallizer rollers are provided inside with cooling means and are able to rotate in opposite directions to convey the liquid steel downwards while it is solidifying in contact with the crystallizer rollers. The cooling means comprise a plurality of holes disposed in proximity with the peripheral surface of each crystallizer roller and inside which a cooling liquid is able to circulate. The cooling liquid flows through at least some of the holes in the opposite direction with respect to the remaining holes.

9 Claims, 2 Drawing Sheets

CRYSTALLIZER WITH ROLLERS FOR A CONTINUOUS CASTING MACHINE

CROSS-REFERENCE TO THE RELATED APPLICATION

This application is a 371 of PCT/B02/01836 filed on May 27, 2002.

FIELD OF THE INVENTION

The invention refers to a crystallizer with two rollers for a continuous casting machine for strip. To be more exact, the invention concerns the cooling system inside the roller, to ensure that there is a determinate uniform temperature along the generatrix of the roller in contact with the liquid steel, where the first solidification occurs.

BACKGROUND OF THE INVENTION

There are known continuous casting machines for steel strip, or similar products, wherein the crystallizer consists substantially of two crystallizer rollers, which are disposed between lateral containing walls and rotate in opposite directions to convey the liquid steel downwards and thus form the cast product.

In the V-shaped space which is created between the two crystallizer rollers, above the horizontal plane passing through their axes of rotation, the liquid steel arriving from a tundish forms a meniscus with a determinate height, which is controlled by means of suitable discharge means, for example of the immersion type or submerged entry nozzle (SEN).

In such continuous casting machines, one of the main problems to be solved is that of having a uniform initial solidification of the liquid steel inside the crystallizer, to create the so-called outer skin of the cast product, for which reason it is necessary to create conditions as equal as possible along the generatrixes of the rollers.

It is possible to ensure a uniform solidification of the liquid steel along the generatrix of the roller by integrating both a uniform distribution of the liquid steel along said generatrix and also a uniform temperature of the crystallizer along the same generatrix.

Until now, such controls have always been difficult and have not brought appreciable results, so that the above technical problem is practically unsolved in the present state of the art.

Document WO-A-93/19874 discloses a rotary roller for continuous casting, provided with longitudinal cooling conduits, parallel to each other and disposed in proximity with the periphery of the roller. The cooling conduits, inside the roller, are connected to each other in order to define a single coil fed by a single inlet conduit and a single outlet conduit, connected to the roller by means of a single rotary joint located laterally and coaxial to the roller. The coil of conduits is disposed so that there is an alternation in the direction of the flow of water between adjacent conduits, and the coil has a double linked spiral, so that the heat gradient on the periphery of the roller is uniform. The disadvantage of this roller is that the cooling water which enters at a relatively low temperature (for example 0° C.), exits from the roller at a relatively high temperature (more than 60° C.); in this way, the cooling conditions of the roller, along the generatrix of the roller in contact with the liquid steel where the first solidification occurs, are not uniform and therefore they can cause the formation of cracks in the cast strip.

Document EP-A-0873805 discloses a casting roller which comprises an inner cylindrical core and an outer tubular casing, forced through interference onto the inner core. Longitudinal conduits, parallel to each other, are provided both on the outer casing and on the inner core, to allow the cooling water to flow inside them and to cool the cylindrical surface of the roller. The conduits end in two circular chambers parallel to the front surfaces of the roller, so that the cooling water enters at one end of the roller and exits at the opposite end. It is also provided that several conduits can be grouped together and that the direction of flow of the water is inverted. The casting roller described in EP-A-0873805 has the same disadvantages as those described in WO-A-93/19874, because when the conduits are grouped together there is the same problem of a non-uniform cooling for the two adjacent conduits where the cooling water changes direction.

The present Applicant has devised, designed and embodied the device according to the invention to solve this technical problem fully and in a satisfactory manner.

SUMMARY OF THE INVENTION

The crystallizer with rollers according to the invention is set forth and characterized in the main claim, while the dependent claims describe other innovative characteristics of the invention.

One purpose of the invention is to achieve a crystallizer with rollers wherein the start of solidification of the liquid steel in the meniscus occurs uniformly.

In accordance with this purpose, the crystallizer according to the invention comprises two crystallizer rollers which are disposed substantially parallel to each other so as to define a meniscus of liquid steel arriving from a container above, and are able to rotate in opposite directions to convey the liquid steel downwards while it solidifies in contact with their opposite cylindrical surfaces. A plurality of longitudinal holes, inside which a cooling liquid is able to circulate, are disposed in proximity with the cylindrical surface of each crystallizer roller.

According to one characteristic of the present invention, the longitudinal holes are divided into two groups of holes, disposed so that the holes of a first group alternate with the holes of a second group along the development of the cylindrical surface. Moreover, each group of holes is connected to an inlet conduit for the cooling liquid disposed on a first side of the crystallizer rollers and an outlet conduit disposed on the opposite side of the crystallizer rollers, so that the cooling liquid flows through the holes of the first group of holes in the opposite direction to that of the holes of the second group of holes. In this way, the cooling liquid passes from one end to the other of each hole and then exits from the crystallizer roller and, moreover, always passes in adjacent holes in opposite directions.

In this way we have the advantage of a uniform solidification of the steel, guaranteed both by the cooling system of each crystallizer roller, which makes the temperature of the cylindrical surface of the latter in the meniscus, along the generatrix, remain substantially uniform, and also by the uniform distribution of the temperature of the liquid steel in the meniscus, and also by the fact that the disturbances of the liquid steel in the meniscus, along the generatrix of each crystallizer roller, are reduced to a minimum.

BRIEF DESCRIPTION OF THE DRAWINGS

These and other characteristics of the invention will be apparent from the following description of a preferential form of embodiment, given as a non-restrictive example with reference to the attached drawings wherein.

DETAILED DESCRIPTION OF A PREFERENTIAL FORM OF EMBODIMENT

Figure 1:
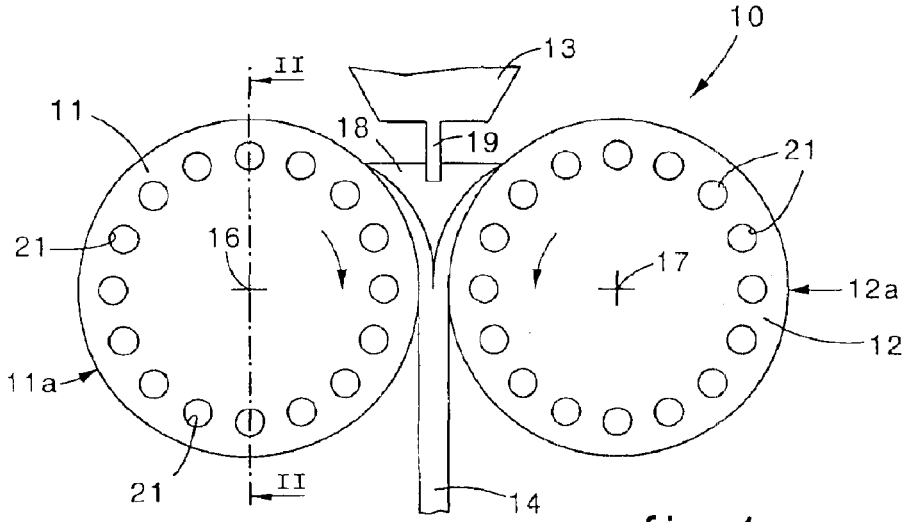
FIG. 1 is a schematic transverse section of a crystallizer with rollers according to the invention.

With reference to the attached Figures, a crystallizer 10 according to the invention comprises two crystallizer rollers 11 and 12, which are able to rotate in opposite directions to convey downwards, while it is solidifying, the liquid steel arriving from an upper container 13 consisting for example of a tundish, an auxiliary or secondary tundish or other container, by means of a nozzle 19, and thus to form the cast product 14, consisting for example of a strip. The nozzle 19 can be for example of the type described in the international patent application PCT/IB02/01269 which the present Applicant filed on 18 Apr. 2002.

The cylindrical surfaces 11*a* and respectively 12*a* of the crystallizer rollers 11 and 12 can be advantageously lined with copper rings.

In the V-shaped space which is created between the two crystallizer rollers 11 and 12, above the horizontal plane passing through their axes of rotation 16 and 17, the liquid steel arriving from the container 13 is able to form a meniscus 18 with a determinate height.

According to the invention, the cooling system of the crystallizer rollers 11 and 12 comprises a plurality of longitudinal holes 21 disposed inside each crystallizer roller 11, 12 and parallel to the axes of rotation 16 and 17, in order to ensure that the cylindrical surfaces 11*a*, 12*a* of the latter have a determinate temperature and that this temperature is as uniform as possible in the meniscus along the generatrix of each roller 11 and 12.

In each crystallizer roller 11 and 12 the holes 21 are divided into two groups of holes, respectively 21*a* and 21*b*, alternating with respect to each other, in which a cooling liquid, such as for example water, is made to circulate in a single path, that is, in such a manner that the cooling liquid enters into each hole 21 from one end thereof and exits from the opposite end, without entering and passing through another hole 21.

Figure 4:
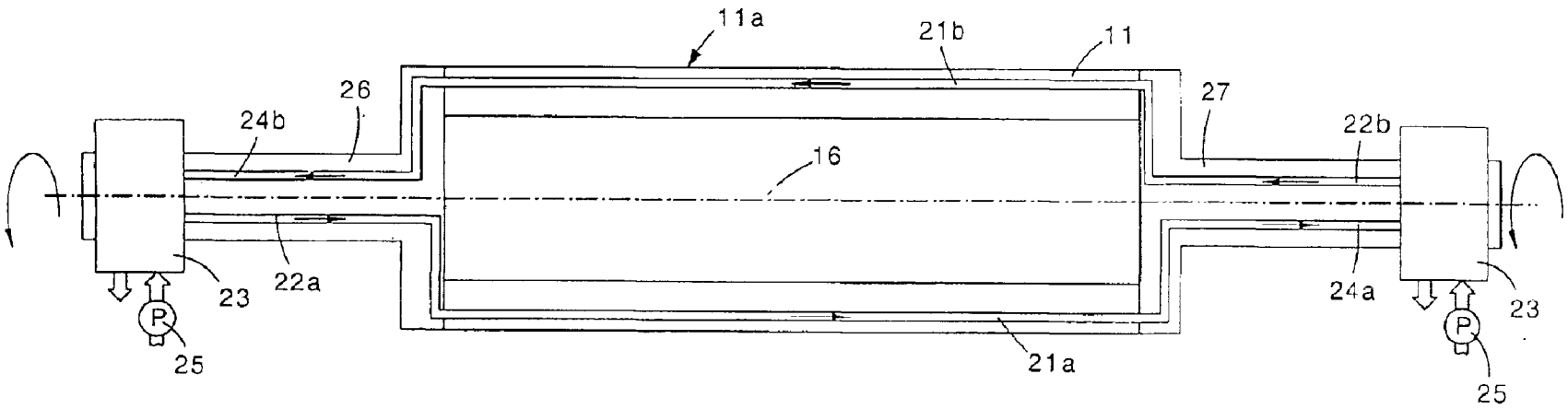
FIG. 4 is a schematic longitudinal section of a crystallizer roller as in FIG. 1, in which the flows of the cooling liquid are shown.

Each hole 21*a* of the first group of holes is in communication, on one side of the crystallizer rollers 11 and 12, with a first inlet conduit 22*a* (FIGS. 2 and 4) for the cooling liquid and, on the opposite side of the crystallizer rollers 11 and 12, with a corresponding outlet conduit 24*a* for the cooling liquid. Each hole 21*b* of the second group of holes is in communication, on one side of the crystallizer rollers 11 and 12, with a second inlet conduit 22*b* for the cooling liquid and, on the opposite side of the crystallizer rollers 11 and 12, with a corresponding outlet conduit 24*b* for the cooling liquid.

To be more exact, the inlet conduit 22*a* of the holes 21*a* of the first group of holes is advantageously disposed on a first side of the crystallizer rollers 11 and 12, while the inlet conduit 22*b* of the holes 21*b* of the second group of holes is disposed on the opposite side of the crystallizer rollers 11 and 12. Since the two groups of holes 21*a* and 21*b* are disposed alternately, so that the flows of cooling liquid have opposite directions in the two groups of holes 21*a* and 21*b*, the outlet conduit 24*a* of the holes 21*a* of the first group of holes is disposed on the same side of the crystallizer rollers 11 and 12 on which there is the inlet conduit 22*b* of the holes 21*b* of the second group of holes. Similarly, the outlet conduit 24*b* of the holes 21*b* of the second group of holes is disposed on the same side of the crystallizer rollers 11 and 12 on which there is the inlet conduit 22*a* of the holes 21*a* of the first group of holes.

In this way, the cooling liquid, entering into each hole 21, both of the first and also of the second group of holes 21*a* and 21*b*, on one side of each crystallizer roller 11, 12 and exiting from the opposite side, increases the temperature thereof only by a little, that is, a few degrees centigrade. Moreover, the cooling liquid which passes through all the holes 21 enters each of said holes 21 at the same temperature, for example, in the case of water, between 25° C. and 30° C., and exits from said holes 21 substantially at the same temperature, for example between 27° C. and 32° C.

In addition, the fact that the cooling liquid is introduced from reciprocally opposite parts into the two groups of holes 21*a* and 21*b* encourages the uniformity of temperature on the cylindrical surfaces 11*a* and 12*a* of the crystallizer rollers 11 and 12.

The inlet conduits 22*a*, 22*b* and the outlet conduits 24*a*, 24*b* for the cooling liquid are disposed inside the terminal shafts 26 and 27 located at the lateral ends of the crystallizer rollers 11 and 12.

Figure 2:
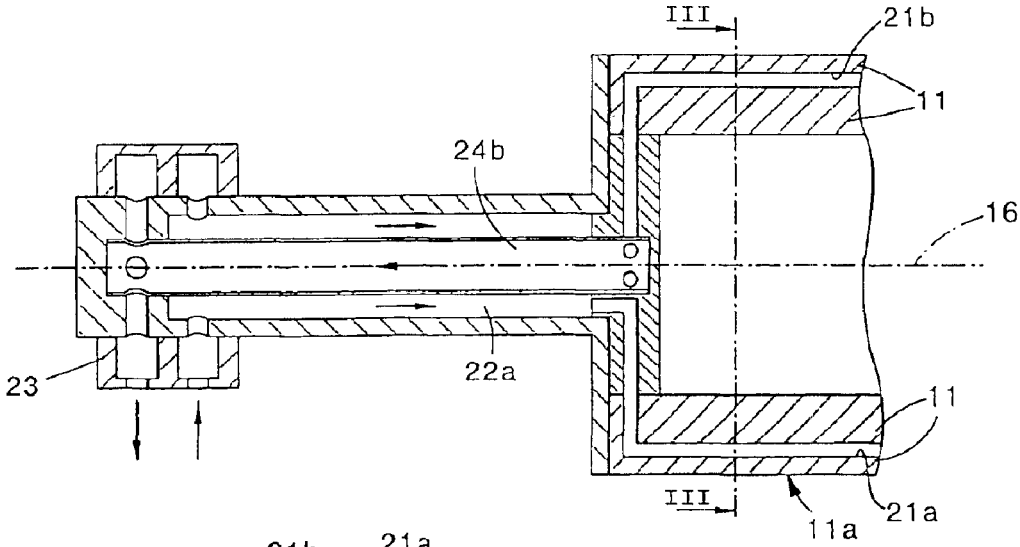
FIG. 2 is a longitudinal and partial section, from II to II of FIG. 1.
Figure 3:
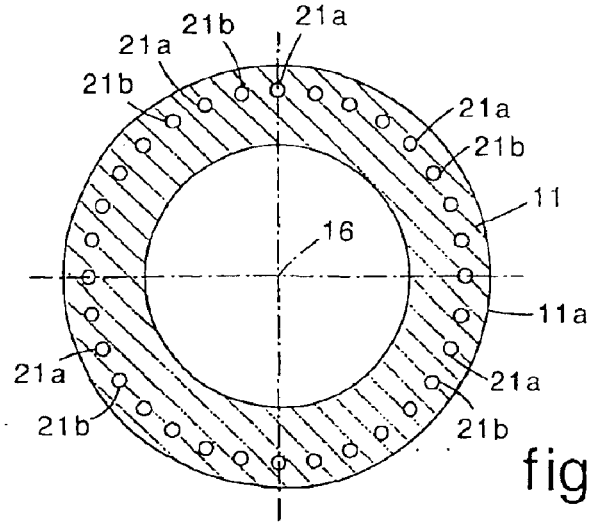
FIG. 3 is a transverse section from III to III of FIG. 2.

In a preferential form of embodiment, as shown in FIG. 2, the inlet conduits 22*a*, 22*b* and the outlet conduits 24*a*, 24*b* are advantageously coaxial and are connected to external feed means of a conventional type, such as a pump 25 or similar, by means of rotary joints 23, also of a conventional type and disposed at the sides of each crystallizer roller 11 and 12.

The circulation of the cooling liquid in the holes 21*a* and 21*b*, in opposite directions, encourages the maintenance of a uniform temperature of the peripheral surface of the two crystallizer rollers 11 and 12, and thus encourages a uniform solidification of the liquid steel which comes into contact with the two crystallizer rollers 11 and 12.

It is clear, however, that modifications and additions of parts can be made to the crystallizer 10 as described heretofore, without departing from the spirit and scope of the invention.

It is also clear that, although the invention has been described with reference to a specific example, a person of skill in the art shall certainly be able to achieve many other forms of equivalent devices, all of which shall come within the field of this invention.

What is claimed is:

1. Crystallizer comprising:

two crystallizer rollers disposed substantially parallel to each other to define a meniscus of liquid steel arriving from a container, wherein each said crystallizer roller has a respective longitudinal axis and cylindrical surface, said crystallizer rollers are able to rotate about the longitudinal axis of the respective crystallizer roller in opposite directions to convey the liquid steel downwards while the liquid steel is solidifying in contact with opposed said cylindrical surfaces of said crystallizer rollers, wherein each said crystallizer roller is internally provided with a plurality of longitudinal holes for circulating a cooling liquid therethrough disposed in proximity with and parallel to the cylindrical surface of said respective crystallizer roller, wherein said plurality of longitudinal holes of each said crystallizer roller comprises a first group of longitudinal holes and a second group of longitudinal holes, wherein for each roller the holes of the first group alternate with the holes of the second group along said cylindrical surface, wherein for each respective roller the holes of said first group are arranged independent from the holes of said second group for preventing passing the cooling liquid introduced into one group of holes from passing through the other group of holes, and wherein for each respective roller each hole of said first group is interconnected with the other holes of said first group and each hole of the second group is interconnected with the other holes of said second group, for flowing said cooling liquid through the holes of said first group of holes in the opposite direction with respect to the holes of said second group of holes, each group of said holes is connected to a respective inlet conduit for said cooling liquid disposed on a respective one side of said respective crystallizer roller and to a respective outlet conduit disposed on a respective opposite side of said respective crystallizer roller, and wherein for each roller said inlet conduit for the first group of holes is disposed on one side of said roller and the inlet conduit for the second group of holes is located on the opposite side of the roller.

2. Crystallizer as in claim 1, wherein the inlet conduit of said first group of holes is disposed on a first side of said crystallizer rollers and the inlet conduit of said second group of holes is disposed on the opposite side of said crystallizer rollers.

3. Crystallizer as in claim 2, wherein an outlet conduit of said first group of holes is disposed on the same side of said crystallizer rollers on which there is the inlet conduit of said second group of holes.

4. Crystallizer as in claim 1, wherein said inlet conduits and said outlet conduits for said cooling liquid are disposed inside the terminal shafts located at the lateral ends of said crystallizer rollers.

5. Crystallizer as claim 1, wherein said cooling liquid is water and is able to enter said holes at a temperature of between about 25° C. and about 30° C.

6. Crystallizer as claim 1, wherein said inlet conduits and said outlet conduits are coaxial and are connected to external feed means outside said crystallizer rollers.

7. Method for cooling two crystallizer rollers of a crystallizer in a continuous casting machine, said method comprising the steps of:

defining a meniscus of liquid steel arriving from a container between opposed cylindrical surfaces of substantially parallel crystallizer rollers, rotating said crystallizer rollers about respective roller longitudinal axes in opposite directions to convey said liquid steel downwards while said liquid steel is solidifying in contact with the opposed cylindrical surfaces of said crystallizer rollers, respectively passing cooling fluid through each of said crystallizer rollers through a plurality of longitudinal holes disposed internally within the respective roller in proximity with and parallel to the cylindrical surface of each of said crystallizer rollers, said plurality of longitudinal holes for each crystallizer roller comprising a first group of longitudinal holes and a second group of longitudinal holes, each hole of said first group of longitudinal holes alternates with each hole of said second group of longitudinal holes;

for each respective roller, passing a respective first cooling fluid stream from a first respective inlet conduit into and through the first group of longitudinal holes to a first outlet conduit in a first direction and passing a respective second cooling fluid stream from a second respective inlet conduit into and through the second group of longitudinal holes to a second outlet conduit in a second direction opposite to said first direction, so that for each respective roller the cooling liquid introduced into one group of holes does not pass through the other group of holes;

for each respective roller each group of holes is connected to a respective said inlet conduit disposed on a side of said roller and to a respective said outlet conduit disposed on the an opposite side of said reller; and wherein for each roller said inlet conduit for the first group of holes is disposed on one side of said roller and the inlet conduit for the second group of holes is located on the opposite side of the roller.

8. Method as in claim 7, wherein the inlet conduit of said first group of holes is disposed on a first side of said crystallizer rollers and the inlet conduit of said second group of holes is disposed on the opposite side of said crystallizer rollers.

9. Method as in claim 8, wherein the outlet conduit of said first group of holes is disposed on the same side of said crystallizer rollers on which there is the inlet conduit of said second group of holes.

* * * * *